US006898293B2

(12) United States Patent
Kaulberg

(10) Patent No.: US 6,898,293 B2
(45) Date of Patent: May 24, 2005

(54) HEARING AID

(75) Inventor: Thomas Kaulberg, Stenløse (DK)

(73) Assignee: Topholm & Westermann ApS, Vaerlose (DK)

( * ) Notice: Subject to any disclaimer, the term of this patent is extended or adjusted under 35 U.S.C. 154(b) by 0 days.

(21) Appl. No.: 10/742,789

(22) Filed: Dec. 23, 2003

(65) Prior Publication Data

US 2004/0136557 A1 Jul. 15, 2004

Related U.S. Application Data

(63) Continuation of application No. 09/725,262, filed on Nov. 29, 2000, now Pat. No. 6,738,486.

(51) Int. Cl.[7] ..... H04R 25/00
(52) U.S. Cl. ..... 381/318; 381/321; 381/71.11
(58) Field of Search ..... 381/312, 317, 381/318, 320, 321, 71.1, 71.11, 71.12, 71.14, 91, 93, 94.1, 94.2, 94.3, 83

(56) References Cited

U.S. PATENT DOCUMENTS

| | | | | |
|---|---|---|---|---|
| 5,016,280 | A | 5/1991 | Engebretson et al. | |
| 5,402,496 | A | 3/1995 | Soli et al. | |
| 5,500,902 | A | 3/1996 | Stockham, Jr. et al. | |
| 5,719,580 | A | 2/1998 | Core | |
| 6,078,612 | A | 6/2000 | Bertrand et al. | |
| 6,173,058 | B1 * | 1/2001 | Takada | 381/151 |
| 6,219,427 | B1 | 4/2001 | Kates et al. | |
| 6,480,610 | B1 | 11/2002 | Fang et al. | |

FOREIGN PATENT DOCUMENTS

| | | |
|---|---|---|
| DE | 198 02 568 A1 | 8/1999 |
| EP | 0814639 A2 | 12/1997 |
| WO | WO 98/47313 | 10/1998 |
| WO | WO 98/56210 | 12/1998 |

OTHER PUBLICATIONS

Lunner et al., "A Digital Filterbank Hearing Aid Design, Implementation and Evaluation" International Conference on Acoustics, Speech & Signal Processing, ICASSP, US, New York, IEEE, vol. CONF. 16, May 14, 1991, pp. 3661–3664.

M. Karjalainen et al, "Comparison of Loudspeaker Equalization Methods Based on DSP Techniques", Journal of the Audio Engineering Society, Audio Engineering Society, New York, US, vol. 47, No 1/2 Jan. 1999, pp. 14–30, XP000823370.

A. Harma, "Implementation of frequency–warped recursive filters", Signal Processing, Amsterdam, NL, vol. 80, No. 3, Mar. 2000, pp. 543–548, XP004188172.

* cited by examiner

*Primary Examiner*—Curtis Kuntz
*Assistant Examiner*—Brian Ensey
(74) *Attorney, Agent, or Firm*—Sughrue Mion, PLLC

(57) ABSTRACT

The present invention relates to a hearing aid with an adaptive filter for suppression of acoustic feedback in the hearing aid. The hearing aid further comprises a controller that is adapted to compensate for acoustic feedback by determination of a first parameter of an acoustic feedback loop of the hearing aid and adjustment of a second parameter of the hearing aid in response to the first parameter whereby generation of undesired sounds is substantially avoided. Hereby a gain safety margin requirement is significantly reduced.

33 Claims, 8 Drawing Sheets

HEARING AID

This Application claims priority from European Application No. 00610097.8 and is a continuation of U.S. application Ser. No. 09/725,262, filed Nov. 29, 2000 now U.S. Pat. No. 6,738,486 the disclosures of which applications are incorporated herein by reference.

FIELD OF THE INVENTION

The present invention relates to a hearing aid with an adaptive filter for suppression of acoustic feedback in the hearing aid.

BACKGROUND OF THE INVENTION

It is well known in the art of hearing aids that acoustic feedback may lead to generation of undesired acoustic signals which can be heard by the user of a hearing aid.

Acoustic feedback occurs when the input transducer of a hearing aid receives and detects the acoustic output signal generated by the output transducer. Amplification of the detected signal may lead to generation of a stronger acoustic output signal and eventually the hearing aid may oscillate.

It is well known to include an adaptive filter in the hearing aid to compensate for acoustic feedback. The adaptive filter estimates the transfer function from output to input of the hearing aid including the acoustic propagation path from the output transducer to the input transducer. The input of the adaptive filter is connected to the output of the hearing aid and the output signal of the adaptive filter is subtracted from the input transducer signal to compensate for the acoustic feedback. A hearing aid of this type is disclosed in U.S. Pat. No. 5,402,496.

In such a system, the adaptive filter operates to remove correlation from the input signal, however, signals representing speech and music are signals with significant autocorrelation. Thus, the adaptive filter cannot be allowed to adapt too quickly since removal of correlation from signals representing speech and music will distort the signals, and such distortion is of course undesired. Therefore, the convergence rate of adaptive filters in known hearing aids is a compromise between a desired high convergence rate that is able to cope with sudden changes in the acoustic environment and a desired low convergence rate that ensures that signals representing speech and music remain undistorted.

The lack of speed of adaptation may still lead to generation of undesired acoustic signals due to acoustic feedback. Generation of undesired acoustic signals is most likely to occur at frequencies with a high feedback loop gain. The loop gain is the attenuation in the acoustic feedback path multiplied by the gain of the hearing aid from input to output.

Acoustic feedback is an important problem in known CIC hearing aids (CIC=complete in the canal) with a vent opening since the vent opening and the short distance between the output and the input transducers of the hearing aid lead to a low attenuation in the acoustic feedback path from the output transducer to the input transducer, and the short delay time maintains correlation in the signal.

Various measures are well known in the art to cope with acoustic feedback. For example, it is well known to keep the loop gain below a certain limit in order to prevent generation of feedback resonance. It is also known to adjust the phase of the feedback signal, to perform a frequency transpose, and to compensate for the feedback signal.

Typically, the acoustic environment of the hearing aid changes over time, and often changes rapidly over time, in such a way that propagation of sound from the output transducer of the hearing aid to its input transducer changes drastically. For example, such changes may be caused by changes in position of the user in a room, e.g. from a free field position in the middle of the room to a position close to a wall that reflects sound. Changes may also be generated if the user yawns or if the user puts the receiver of a telephone to the ear. Such changes, some of which may be almost instantaneous, are known to involve changes in attenuation of the feedback path of more than 20 dB.

It is known to keep the loop gain below a safe limit by limiting the gain adjustment in the hearing aid to a maximum allowable gain based on experience. However, a large safety margin is needed to cope with the above-mentioned variations in the acoustic environment and with variations in physical fitting of the hearing aid to the wearer. It is also known to determine the maximum allowable gain during fitting of the hearing aid to a specific user. However, a large safety margin is still needed. The safety margin prevents the capabilities of the hearing aid to be fully exploited, such as in situations where the gain could be adjusted to a value that is higher than the maximum allowable gain without generation of undesired sounds.

In order to be able to compensate for a severe hearing deficiency, it is desirable to be able to set a high gain in the hearing aid. However, the risk of generating oscillation, also denoted feedback resonance, restricts the maximum gain that may be employed, even in situations with a high attenuation in the acoustic feedback path.

In DE-A-19802568 and U.S. Pat. No. 5,016,280, a hearing aid is disclosed including a measuring system for determining the characteristics of the acoustic feedback path. A test signal is transmitted through the system in order to determine the characteristics of the feedback path.

In DE-A-19802568 the coefficients in a digital filter are determined based on the impulse response of the feedback path, and in U.S. Pat. No. 5,016,280 the filter coefficients of an adaptive compensation filter are calculated using a leaky LMS algorithm operating on white-noise signals transmitted through the feedback path.

The respective measuring systems are rather complicated and the duration of the determination is relatively long, and the normal function of the hearing aid is interrupted during the determination. Thus, the determination is performed at certain occasions only, e.g. when the user switches the hearing aid on. Thus, still, a relatively high safety margin for the gain is needed to cope with changes in the acoustic environment between determinations.

In U.S. Pat. No. 5,619,580 a hearing aid with an adaptive filter and a continuously operating measuring system is disclosed. A pseudo random noise signal is injected into the output signal. A monitoring system controls the gain of the hearing aid so that the loop-gain is kept below a constant value which may be frequency dependent. The filter coefficients of the adaptive filter are monitored and their update rate is adjusted according to a statistical analysis which complicates the system. It is another disadvantage of the system that a noise generator is needed and that the generated noise signal is always present. Moreover, the system increases the adaptation rate and thus deteriorates the signal quality when a change in acoustic environment is detected also in situations where the hearing aid is not operating close to resonance.

Thus, there is a need for an improved hearing aid that overcomes the above-mentioned disadvantages and substantially eliminates the requirement of a gain safety margin so that the operating gain in certain acoustic environments can be higher than for known hearing aids.

SUMMARY OF THE INVENTION

According to a first aspect of the invention, these and other objects are fulfilled by a hearing aid with an adaptive filter for compensation of acoustic feedback. The adaptive filter operates to estimate the transfer function from output to input of the hearing aid including the acoustic propagation path from the output transducer to the input transducer. The input of the adaptive filter is connected to the electric output of the hearing aid and the output signal of the adaptive filter may be subtracted from the input transducer signal to compensate for the acoustic feedback.

The hearing aid comprises an input transducer for transforming an acoustic input signal into a first electrical signal, a first filter bank with bandpass filters for dividing the first electrical signal into a set of bandpass filtered first electrical signals, a first set of combining nodes for receiving said set of bandpass filtered first electrical signals and combining them with a set of third electrical signals in order to output a first set of combining node output signals, a processor adapted for individual processing of each signal among the set of combining node output signals and adding together the processed electrical signals in order to generate a second electrical signal, an output transducer for transforming said second electrical signal into an acoustic output signal, a second filter bank with bandpass filters for dividing said second electrical signal into a set of bandpass filtered second electrical signals, the bandpass filters of the second filter bank being substantially identical to respective bandpass filters of the first filter bank, a first set of adaptive filters for estimating acoustic feedback by filtering of the bandpass filtered second electrical signals according to a set of first filter coefficients and generating the set of third electrical signals, a second set of adaptive filters with second filter coefficients for filtering the bandpass filtered second electrical signals into respective fourth electrical signals, a second set of combining nodes for generation of fifth electrical signals by combining the fourth electrical signals with the respective signals of said first set of combining node output signals, and for inputting said fifth electrical signals to said second set of adaptive filters for adjustment of the second filter coefficients, and a controller adapted to determine a first parameter of an acoustic feedback loop of the hearing aid and to adjust a first adaptation rate of said set of first filter coefficients, wherein said controller is adapted to determine a second parameter of an acoustic feedback loop of the hearing aid and to adjust the second filter coefficients with a second adaptation rate that is higher than the first adaptation rate, and wherein said controller is adapted to estimate the amount of acoustic feedback based on information from said second set of adaptive filters.

It is an important advantage of the present invention that the requirement of a gain safety margin is significantly reduced since the controller automatically adjusts a parameter of the electronic feedback loop whenever the hearing aid operates with a high risk of generating undesired sounds so that such generation is substantially avoided.

In the following, the frequency ranges of the bandpass filters are also denoted channels.

The invention, in a second aspect, provides a hearing aid comprising an input transducer for transforming an acoustic input signal into a first electrical signal, a processor for generation of a second electrical signal by processing of said first electrical signals into a second electrical signal, an output transducer for transforming the second electrical signal into an acoustic output signal, a first adaptive filter with first filter coefficients for estimation of acoustic feedback by generation of a third electrical signal by filtering of said second electrical signal and adapting said third signal to said first first electrical signal, which first adaptive filter is a warped adaptive filter, wherein the first filter coefficients are updated with a first convergence rate, a set of second adaptive filters with second filter coefficients for filtering said second electrical signals into respective fourth electrical signals, and a combining node for generation of fifth electrical signals by combining the fourth electrical signals with the respective first electrical signals and for inputting the fifth electrical signals to said set of second adaptive filters, and wherein the second filter coefficients are updated with a second convergence rate that is higher than the first convergence rate.

The invention, in a third aspect, provides a hearing aid comprising an input transducer for transforming an acoustic input signal into a first electrical signal, a first filter bank with bandpass filters for dividing the first electrical signal into a set of bandpass filtered first electrical signals, a first set of combining nodes for receiving said set of bandpass filtered first electrical signals and combining them with a set of third electrical signals in order to output a first set of combining node output signals, a processor adapted for individual processing of each signal among the set of combining node output signals and adding together the processed electrical signals in order to generate a second electrical signal, an output transducer for transforming said second electrical signal into an acoustic output signal, a second filter bank with bandpass filters for dividing said second electrical signal into a set of bandpass filtered second electrical signals, the bandpass filters of the second filter bank being substantially identical to respective bandpass filters of the first filter bank, a first set of adaptive filters for estimating acoustic feedback by filtering of the bandpass filtered second electrical signals according to a set of first filter coefficients and generating the set of third electrical signals, and a controller adapted to determine an operating gain of the processor and to adjust a first adaptation rate of said set of first filter coefficients according to the operating gain.

In a simple embodiment of the invention, the hearing aid is a single channel hearing aid, i.e. the hearing aid processes incoming signals in one frequency band only. Thus, the first filter bank consists of a single bandpass filter, and the single bandpass filter may be constituted by the bandpass filter that is inherent in the electronic circuit, i.e. no special circuitry provides the bandpass filter. Correspondingly, the adding in the processor of processed electrical signals is reduced to the task of providing the single processed electrical signal at the output of the processor. Further, the second filter bank consists of a single bandpass filter, and the first set of adaptive filters consists of a single adaptive filter.

Typically, hearing defects vary as a function of frequency in a way that is different for each individual user. Thus, the processor is preferably divided into a plurality of channels so that individual frequency bands may be processed differently, e.g. amplified with different gains. Correspondingly, the hearing aid may comprise a first set of adaptive filters with a plurality of adaptive filters for individual filtering of signals in respective frequency bands whereby a capability of individually controlling acoustic feedback in each channel of the hearing aid is provided. Preferably, the frequency bands of the first set of adaptive filters are substantially identical to the frequency bands of the first filter bank so that the bandpass filters do not deteriorate the operation of the adaptive filters.

In one embodiment of the invention, the first set of adaptive filters subtracts the electrical output of the hearing aid from the input to the processor and the difference signal is used for modification of the filter coefficients as explained below. The difference signal is not used for modification of the input signal to the processor whereby distortion of the signal is avoided. Thus, in this embodiment of the invention the first adaptive filter is used for estimation of the acoustic feedback signal without distortion of the processed signal. Further, in this embodiment, at least one of the adaptive filters of the first set of adaptive filters may operate on a respective decimated bandpass filtered second electrical signal whereby signal processing power requirement is minimized without requiring additional filters since the adaptive filter output signal does not affect the processed signal directly.

In another embodiment of the invention, the first set of adaptive filters subtracts the electrical output of the hearing aid from the electrical signal from the input transducer and the difference signal is used for modification of the filter coefficients and is fed to the input of the processor whereby the acoustic feedback signal is substantially removed from the signal before processing by the processor. In this embodiment, decimation of signals may be employed in the processor and in the first set of adaptive filters if a third filter bank that is substantially identical to the first filter bank is added in the processor before summation of the individual processed signals from each processor channel to the output signal from the processor.

Generation of undesired sounds may be avoided by monitoring of the loop gain of the acoustic feedback loop, i.e. the gain of the acoustic feedback path from the output transducer to the input transducer including the transfer functions of the transducers plus the gain of the electronic circuitry included in the signal path from input to output of the hearing aid. When the loop gain approaches one, certain actions may be taken to prevent generation of unwanted sounds. Since the first set of adaptive filters generates a signal that corresponds to the signal generated by acoustic feedback, monitoring of attenuation in the first set of adaptive filters and of gains in corresponding channels of the processor provides an indication of the loop gain of the acoustic feedback loop. Thus, the controller may be adapted to monitor attenuation in the first set of adaptive filters, e.g. by determination of the individual ratios between the magnitude of the signal at the inputs of the individual filters and the signals at the corresponding outputs of the individual filters. Further, the controller may be adapted to monitor the gains of the individual channels of the processor, e.g. by a similar determination of input and output signal levels of individual processor channels, or by reading values from registers in the processor containing current gain values of individual processor channels. Typically, the processor channel gains are different for different channels and they are input level dependent.

Based on the monitoring of a first parameter of the acoustic feedback loop, such as the loop gain, the gain of a processor channel, the attenuation of an adaptive filter of the first set of adaptive filters, etc, a second parameter of the hearing aid may be adjusted to prevent generation of undesired sounds. For example, the gain of at least one processor channel may be modified, e.g. lowered, to keep the acoustic feedback loop gain below one.

The second parameter may be a maximum gain limit $G_{max}$ that the gain of the processor is not allowed to exceed within a specific channel. The adaptation rate of the first set of adaptive filters may be kept constant while the maximum gain limit $G_{max}$ of a specific channel of the processor is lowered whenever the hearing aid approaches a state in that channel with a high risk of generating undesired sounds, e.g. caused by a sudden change in the acoustic environment. For example, the maximum gain limit $G_{max}$ of a specific channel is lowered while the first adaptive filter adapts to a changed acoustic environment, and is restored to the original value when the adaptive filter has adapted to the new situation. Hereby, no distortion of the desired signal is generated.

It is an important advantage of this embodiment of the invention that the operating gain of the hearing aid may be very high without a risk of generating undesired sounds since the gain is automatically lowered if the feedback loop approaches resonance. Thus, a gain safety margin is substantially not required.

In embodiments wherein the bandpass filters of the second filter bank are substantially identical to respective bandpass filters of the first filter bank, each channel may be individually controlled based on a determination in that channel whereby reduction of gain by influence from frequencies outside the channel in question may be avoided.

Further, in an embodiment of the invention wherein the difference signal from the first adaptive filter is fed to the input of the processor, the second parameter may be a first convergence or adaptation rate of the first set of adaptive filters. For example, the adaptation rate of the filter may be made dependent on the operating processor gain in such a way that whenever the hearing aid approaches a state with a high risk of generating undesired sounds, e.g. caused by a sudden change in the acoustic environment, the adaptation rate of the first adaptive filter is increased to rapidly compensate for the change.

The convergence rate of the first set of adaptive filters may be adjusted by modifying the algorithm for updating the filter coefficients of the adaptive filter. As further described below, the algorithm may comprise one or more scaling factors that may be adjusted in response to the determination of the first parameter. For example, the one or more scaling factors may be adjusted as a predetermined function of the operating gains of the processor.

It is an important advantage of this embodiment that the operating gain of the hearing aid may be very high without a risk of generating undesired sounds since the closer the acoustic feedback loop gain approaches resonance the faster the adaptive filter will adapt to the situation. The fast adaptation of the adaptive filter may cause the desired signal to be distorted as previously described. However, as soon as the adaptive filter has adapted, the convergence rate is lowered and the desired signal is no longer distorted. Further, the distortion may take place in a frequency band that does not affect the intelligibility of the received sound signal.

A gain interval from $G_0$ to $G_a$ may be provided in the hearing aid. $G_0$ is a predetermined lower gain limit below which feedback resonance and generation of undesired sounds can not occur. $G_0$ may be determined during the fitting procedure. $G_a$ is an adjustable upper gain limit that is adjusted according to desired sound quality. Preferably, $G_a$ is adjusted during the fitting procedure.

The convergence rate may vary as a predetermined function, such as a linear or a non-linear function, of the gain of the processor, e.g. in the range from $G_o$ to $G_a$. For example, one or more scaling factors of the updating algorithm of the adaptive filter may vary as a predetermined function, such as a linear or a non-linear function, of the gain of the processor, e.g. in the range from $G_o$ to $G_a$.

During fitting of the hearing aid to the individual user, the transmission characteristics of the feedback path is measured. Based on these characteristics, the values of $G_0$ and $G_a$ with appropriate safety margins are determined and stored in the hearing aid. For determination of $G_0$ there are several factors to take into consideration. The feedback path characteristics are, as already mentioned, not constant. Thus, sudden changes may lead to feedback resonance if the feedback compensation is too slow. Further, prediction of the magnitude and duration of changes of the attenuation of the feedback path may be difficult. On the other hand, fast adaptation may lead to unacceptable distortion of the desired signal, the level of unacceptable distortion again being a subjective quantity.

However, in situations where the characteristics of the acoustic feedback path have been stable for a certain period it is possible to estimate the characteristics of the feedback path accurately since in such a situation the relation between the signals at the inputs of the first set of adaptive filters and the signals at the outputs of the first set of adaptive filters is a precise measure for such characteristics, e.g. the attenuation, of the acoustic feedback path. Knowing the gain characteristics of the digital processor and of the acoustic feedback signal, an estimate for the acoustic feedback loop may be provided. From this knowledge, a dynamically changing value of $G_0$ may be incorporated in the hearing aid. In one embodiment the interval from $G_0$ to $G_a$ may have a fixed size, independent of the changes in $G_0$, i.e. the entire interval is shifted in accordance with changes of $G_0$.

According to a preferred embodiment of the invention, the hearing aid further comprises a second set of adaptive filters operating in parallel with, i.e. on the same signals as, the first set of adaptive filters but with second convergence rates that are higher than the first convergence rates of the first set of adaptive filters. The outputs of the first set of adaptive filters are fed to the corresponding inputs of the processor whereby the acoustic feedback signal is substantially removed from the signal before processing by the processor. The outputs of the second set of adaptive filters are not used for modification of the processor input signals.

In this embodiment, the controller is adapted to estimate the amount of acoustic feedback by determination of a parameter of the second set of adaptive filters. The high second convergence rate allows the second adaptive filter to track the acoustic feedback more closely over time than the first adaptive filter. Further, since the output signal of the second adaptive filter is not subtracted from the input transducer signal, the desired signal is not distorted by the second adaptive filter.

Thus, according to a preferred embodiment of the invention, a hearing aid is provided further comprising a set of second adaptive filters with second filter coefficients for suppression of feedback in the hearing aid by filtering the bandpass filtered second electrical signals into respective fourth electrical signals, a combining node for generation of fifth electrical signals by subtraction of the fourth electrical signals from the respective bandpass filtered first electrical signals and for feeding the fifth electrical signals to the processor, and wherein the second filter coefficients are updated with a second convergence rate that is higher than the first convergence rate.

The amount of acoustic feedback may be estimated by determination of the ratio between the magnitude of the signals at the inputs of the second set of adaptive filters and the signals at the respective outputs of the second set of adaptive filters. This approach provides a quick response to changes in the acoustic feedback path and requires very little processor power.

The second parameter may be a second convergence or adaptation rate of the first set of adaptive filters. For example, the adaptation rate of the filtering may be made dependent on the operating gain of the processor or, the attenuation of the second set of adaptive filters or, a combination of the two, in such a way that whenever the hearing aid approaches a state with a high risk of generating undesired sounds, e.g. caused by a sudden change in the acoustic environment, the adaptation rate of the first adaptive filter is increased to rapidly compensate for the change.

As previously described for the second set of adaptive filters, the convergence rate of the first set of adaptive filters may be adjusted by modifying the algorithm for updating the filter coefficients of the adaptive filters. As further described below, the algorithm may comprise one or more scaling factors that may be adjusted in response to the determination of the second parameter. For example, the one or more scaling factors may be set as a predetermined function of the operating gains of the processor.

The first set of adaptive filters provides individual filtering of signals in respective frequency bands. Preferably, the frequency bands of the first set of adaptive filters are substantially identical to the frequency bands of the second filter bank.

The frequency bands of the first set of adaptive filters may differ in number and range from the frequency bands of the first filter bank and the second set of adaptive filters. However, in a preferred embodiment of the present invention, the second filter bank comprises a plurality of bandpass filters while the first set of adaptive filters consists of a single adaptive filter providing modification of the processor input signal in a single frequency band whereby a hearing aid with a frequency dependent hearing aid compensation capability is provided with a simple single band acoustic feedback compensation loop.

Thus, according to a preferred embodiment of the present invention, a hearing aid is provided further comprising a second adaptive filter with second filter coefficients for suppression of feedback in the hearing aid by filtering the second electrical signal into a fourth electrical signal, a combining node for generation of a fifth electrical signal by subtraction of the fourth electrical signal from the first electrical signal and for feeding the fifth electrical signal to the respective bandpass filters of the first filter bank, and wherein the second filter coefficients are updated with a second convergence rate that is higher than the first convergence rate.

Thus, in a preferred embodiment of the invention, the processor and the second adaptive filter are divided into channels covering the same frequency bands while the first adaptive filter is not divided into a plurality of channels. Further, the controller may be adapted to control the individual maximum gain limits $G_{max}$ of each processor channel in response to determination of the attenuation of the corresponding first adaptive filter channel. The controller may further be adapted to increase a second convergence rate of a filter of the second set of adaptive filters when the corresponding processor channel gain is limited by a $G_{max}$ limit so that the duration of the gain limitation may be decreased. Still further, the controller may be adapted to adjust the gain limit and/or the convergence rate in accordance with the current mode of operation of the hearing aid. The term mode of operation will be explained below.

Preferably, at least one adaptive filter is a finite impulse response (FIR) filter, and even more preferred at least one adaptive filter is a warped filter, such as a warped FIR filter, a warped infinite impulse response (IIR) filter, etc.

In the present example of a warped FIR filter, the unit delays are substituted by first order allpass sections. However, the warping may as well be realized with second order and even higher order allpass sections. A first order allpass section has the z-transform:

$$\frac{z^{-1}-\gamma}{1-z^{-1}\gamma}$$

where $\gamma$ is a warping parameter. Thus, the fixed delays in a FIR filter are substituted by frequency dependent delays leading to large delays at low frequencies and smaller delays at high frequencies. It should also be noted that the allpass elements are internally recursive and therefore warped FIR filters have infinite impulse responses. Thus, the term warped FIR is somewhat contradictory but describes well the structural analogy to transversal FIR filters.

In embodiments of the present invention, the order of a warped FIR filter may be considerably lower than the order of a FIR filter with comparable specifications. Thus, for a given circuit complexity, a warped FIR filter is capable of providing better filter characteristics than a FIR filter. Further, the warping parameter y may be used as a control parameter for controlling the transfer function, i.e. the positioning of resonances and cut-off frequencies in the frequency spectrum, whereby the spectrum of the error signal e(n), i.e. the difference between the filter output signal and the desired signal, may be minimized within a desired frequency range.

In the FIR or warped FIR filter, the next sample Y(t+T) is calculated according to the following equation:

$$Y(t+T)=\underline{c}(t)\underline{u}(t)$$

$$\text{wherein } \underline{c}(t)=\begin{pmatrix} c_0 \\ c_1 \\ \vdots \\ c_i \\ \vdots \\ c_{N-1} \end{pmatrix} \text{ and } \underline{u}(t)=\begin{pmatrix} u_0 \\ u_1 \\ \vdots \\ u_i \\ \vdots \\ u_{N-1} \end{pmatrix}=\begin{pmatrix} u(t) \\ u(t-T) \\ \vdots \\ u(t-iT) \\ \vdots \\ u(t+T-NT) \end{pmatrix}$$

It is noted that $\underline{u}$ is an N dimensional vector containing the latest N samples of the signal u and $\underline{c}$ is a vector containing the N coefficients of the N'th order filter. T is the sampling period.

In the equation, u(t) is the actual value at the actual time t, and u(t−iT) is the signal value at i sampling periods prior to the actual time t. In discrete time systems, a shorthand notation is often used where the symbol u(i) indicates the signal value at the time t−iT, i.e. u(t−iT) in the equation above.

It is well known, e.g. cf. Adaptive Filtering by Paulo S. R. Diniz, Kluwer Academic Publishers, 1997, to use a least mean square algorithm for updating of the filter coefficients in an adaptive filter:

$$\underline{c}(t+T)=\underline{c}(t)+\mu\underline{u}(t)e(t)$$

Using the above-mentioned shorthand notation (n is the reference number of the actual sample), the equation is rewritten:

$$\begin{pmatrix} c_0(n+1) \\ c_1(n+1) \\ \vdots \\ c_i(n+1) \\ \vdots \\ c_{N-1}(n+1) \end{pmatrix}=\begin{pmatrix} c_0(n) \\ c_1(n) \\ \vdots \\ c_i(n) \\ \vdots \\ c_{N-1}(n) \end{pmatrix}+\mu\cdot e(n)\cdot\begin{pmatrix} u_0(n) \\ u_1(n) \\ \vdots \\ u_i(n) \\ \vdots \\ u_{N-1}(n) \end{pmatrix}$$

Or in an even shorter form:

$$c_i(n+1)=c_i(n)+\mu u_i(n)e(n)$$

wherein i references the individual vector elements.

It is preferred to use a leaky least mean square algorithm for updating the filter coefficients:

$$c_i(n+1)=\lambda(c_i(n)-c_i(0))+c_i(0)+\mu u_i(n)e(n),$$

where $u_i$ is a set of signal values derived from the output signal of digital processor in the n'th sampling period and the i−1 preceding sampling periods, $c_i$ is a set of filter coefficients, e is the current value of the error signal and $\lambda$ and $\mu$ are scaling factors. The value of $\mu$ is typically in the magnitude of $10^{-6}$ and the value of $\lambda$ is typically approximately 0.99. $\lambda$ is denoted leakage and when $\lambda<1$, the filter coefficients will drift towards their respective initial values $c_i(0)$. $\mu$ is the convergence rate and determines the rate with which the adaptive filter adapts to a change. The adaptation rate increases with increasing values of $\mu$.

It may further be advantageous to normalize the algorithm so that the adaptive filter, substantially, does not respond to momentary dynamic changes in the input signal. It should be noted that for the purpose of estimating the acoustic feedback signal, the desired input signal is irrelevant and constitutes noise deteriorating the convergence performance of the adaptive filter. The normalized algorithm is referred to as a normalized Least Mean Square (nLMS) algorithm:

$$\underline{c}(n+1)=\lambda(\underline{c}(n)-\underline{c}(0))+\underline{c}(0)+\mu\frac{\underline{u}(n)}{\underline{u}(n)^{\circ}\underline{u}(n)}e(n).$$

However in the above equation the calculation of the power requires significant processing power and consequently, it is preferred to use a power estimate according to the equation:

$$P_u(t+T)=\alpha P_u(t)+(1-\alpha)u^2(t)$$

where $\alpha$ is a predetermined constant that determines the rate with which the $P_u$ estimate changes. The algorithm is referred to as a power normalized Least Mean Square algorithm. The power estimate may also be based on the output signal from the input transducer so that the influence from sudden changes in the power of the input signal on the adaptation algorithm is minimized.

Further, a third update algorithm may be used for updating the adaptive filter coefficients denoted a leaky sign least mean square algorithm:

$$c_i(n+1)=\lambda(c_i(n)-c_i(0))+c_i(0)+\mu_s u_i(n)$$

where $\mu_s$ is the sign of the e(n) signal multiplied by $\mu$.

Still further, a fourth update algorithm that may be used for the adaptive filter coefficients denoted a leaky sign-sign least mean square algorithm:

$$c_i(n+1)=\lambda(c_i(n)-c_i(0))+c_i(0)+\mu_s\operatorname{sgn}(u_i(n))$$

where $\operatorname{sgn}(u_i(n))$ is the sign of $u_i(n)$.

The filter coefficients may be updated based on a difference signal that is processed, e.g. combined with another signal, averaged or otherwise filtered, etc. Filtering may be performed in a focussed manner as known in the art.

Further, it should be noted that in a multichannel hearing aid according to the invention, the adaptive filters of the channels need not have identical number of taps. For example, it may be desirable to include more taps in adaptive filters operating in low-frequency channels.

As already mentioned, the controller may adjust $\lambda$ and $\mu$ in response to the determination of a first parameter of the acoustic feedback loop of the hearing aid.

Various sets of parameters of the hearing aid may be provided for various respective types of sound, e.g. speech, music, etc, that the user desires to hear and various respective types of acoustic environment, e.g. silence, noise, echo, crowd, open air, room, head set, etc, in which the user is situated. For example, various gain settings as a function of frequency may be provided, various gain settings as a function of input signal level may be provided, and various convergence rates as a function of operating processor gain may be provided, etc. Each set of parameters defines a specific mode of operation of the hearing aid and when the hearing aid operates with a specific set of parameters it is said to operate in the corresponding mode. Thus, in a specific mode of operation, specific parameter values of the hearing aid are set for appropriately processing of corresponding specific sounds in a specific acoustic environment. Likewise automatic adjustment of the parameters may be performed in accordance with the current mode of operation.

The type of sound may be selected by the user or, it may be automatically detected by the hearing aid, e.g. by a frequency analysis, analysis of signal to noise ratio at various frequencies, analysis of sound dynamics, speech recognition, recognition by neural networks, etc.

Likewise, the type of acoustic environment may be selected by the user or, it may be automatically detected by the hearing aid, e.g. by a frequency analysis, analysis of signal to noise ratio at various frequencies, analysis of sound dynamics, recognition by neural networks, etc.

For example, the user may desire to listen to music. The first convergence rate of the first adaptive filter may then be set to a value that is in conformance with the auto-correlation of music. Further, gain adjustments or adjustments of the first convergence rate may also be performed in conformance with the auto-correlation of music. For example, when the first convergence rate, e.g. one or more scaling factors, is controlled as a function of processor gain, the function may be selected from a set of functions, each of which is adapted for use in a specific acoustic environment with certain sounds, such as music, speech, etc, that the user has decided to listen to.

Furthermore, adjustments may also be performed in accordance with the rate of change of measured parameters, e.g. of the acoustic feedback path, e.g. the feedback gain, etc, etc.

BRIEF DESCRIPTION OF THE DRAWINGS

The invention will now be explained in greater detail with reference to the drawings in which.

DETAILED DESCRIPTION OF THE PREFERRED EMBODIMENTS

Figure 1:
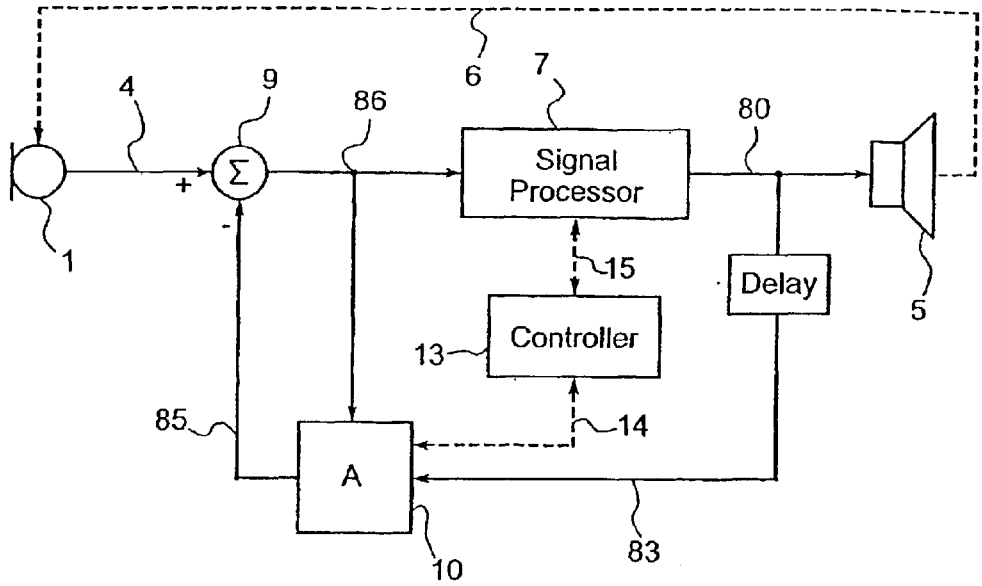
FIG. 1 is a block diagram of a hearing aid according to the present invention.

FIG. 1 is a schematic block diagram of an embodiment of the present invention. It will be obvious for the person skilled in the art that the circuits indicated in FIG. 1 may be realized using digital or analogue circuitry or any combination hereof. In the present embodiment, digital signal processing is employed and thus, the processor 7 and the adaptive filter 10 are digital signal processing circuits. In the present embodiment, all the digital circuitry of the hearing aid may be provided on a single digital signal processing chip or, the circuitry may be distributed on a plurality of integrated circuit chips in any appropriate way.

In the hearing aid an input transducer 1, such as a microphone, is provided for reception of sound signals and conversion of the sound signals into corresponding electrical signals representing the received sound signals. The hearing aid may comprise a plurality of input transducers 1, e.g. whereby certain direction sensitive characteristics may be provided. The input transducer 1 has a transfer function $H_m$. The input transducer 1 converts the sound signal to an analogue signal. The analogue signal is sampled and digitized by an A/D converter (not shown) into a digital signal 4 for digital signal processing in the hearing aid. The digital signal 4 is fed to a combining node 9 where it is combined with a feedback compensation signal 85 which will be explained later. The combining node 9 outputs an output signal 86 which is fed to a digital signal processor 7 for amplification of the output signal 86 according to a desired frequency characteristic and compressor function to provide an output signal 80 suitable for compensating the hearing deficiency of the user.

The output signal 80 is fed to an output transducer 5 and an optional delay $\Delta$ and the delayed signal 83 is fed to an adaptive filter A, reference 10. The output transducer 5 converts the output signal 80 to an acoustic output signal. A part of the acoustic signal propagates to the input transducer 1 along a feedback path 6 having a transfer function $H_{fb}$. Preferably, the time delay of the delay line $\Delta$ is substantially equal to the transit time along the feedback path 6 from the output transducer 5 to the input transducer 1. Other time delays may be selected. However, shorter time delays or zero time delay complicates the filtering, e.g. when the filters are Finite Impulse Response filters longer filters will be necessary, i.e. filters with more taps. Thus, a further delay may be inserted in the circuit at the output of the processor 7, feeding a delayed signal to the output transducer 5 and the optional delay Δ, thereby decreasing the correlation between input signal 4 and filtered signal 85.

In the adaptive filter 10, the delayed signal 83 is filtered in order to provide a filtered signal 85 that is an estimate of the acoustic feedback, i.e. the filtered signal 85 is an estimate of the part of the transducer generated signal 4 that is generated by reception of sound originating from the output transducer 5. The filtered signal 85 is subtracted from the digital input signal 4 in the combining node 9 whereby a feedback compensated signal 86 is provided and input to the digital processor 7. In order to compensate for changes in the acoustic feedback path, the filter coefficients of the adaptive filter 10 are continuously updated so that the filtered signal 85 stays substantially identical to the signal propagated along the feedback path 6.

The filter 10 is a finite impulse response (FIR) filter or a warped FIR filter with a leaky sign-sign least mean square algorithm as disclosed above.

Figure 10:
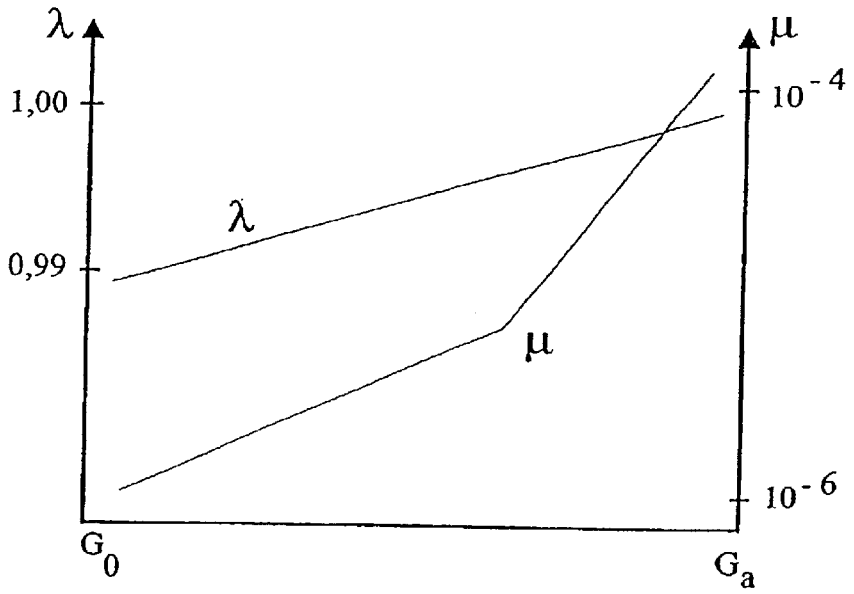
FIG. 10 is a diagram representing possible variations in the filter coefficients in dependence of the gain in the digital processor.

The controller adjusts $\lambda$ and $\mu$ in response to the actual gain in the processor 7. A plot of the scaling factors $\lambda$ and $\mu$ as functions of the gain is shown in FIG. 10. It should be noted that these functions may depend on the mode of operation of the hearing aid. A set of selectable subsets of functions as those shown in FIG. 10 may be provided that may be selected by the controller 13 in accordance with the current mode of operation of the hearing aid. Further, the functions may be selected in accordance with the rate of change of a measured parameter, e.g. attenuation in the acoustic feedback path.

In the embodiment of FIG. 1 the controller 13 receives information from the digital processor 7 via a line 15. According to the information received via line 15 about the current operating gain in the digital processor 7, the controller adjusts the adaptation rate for the filter coefficients of the adaptive filter 10. It should be noted that in the present drawing, dashed lines and arrows indicate control lines that do not form part of the signal path of the processed signal.

Figure 6:
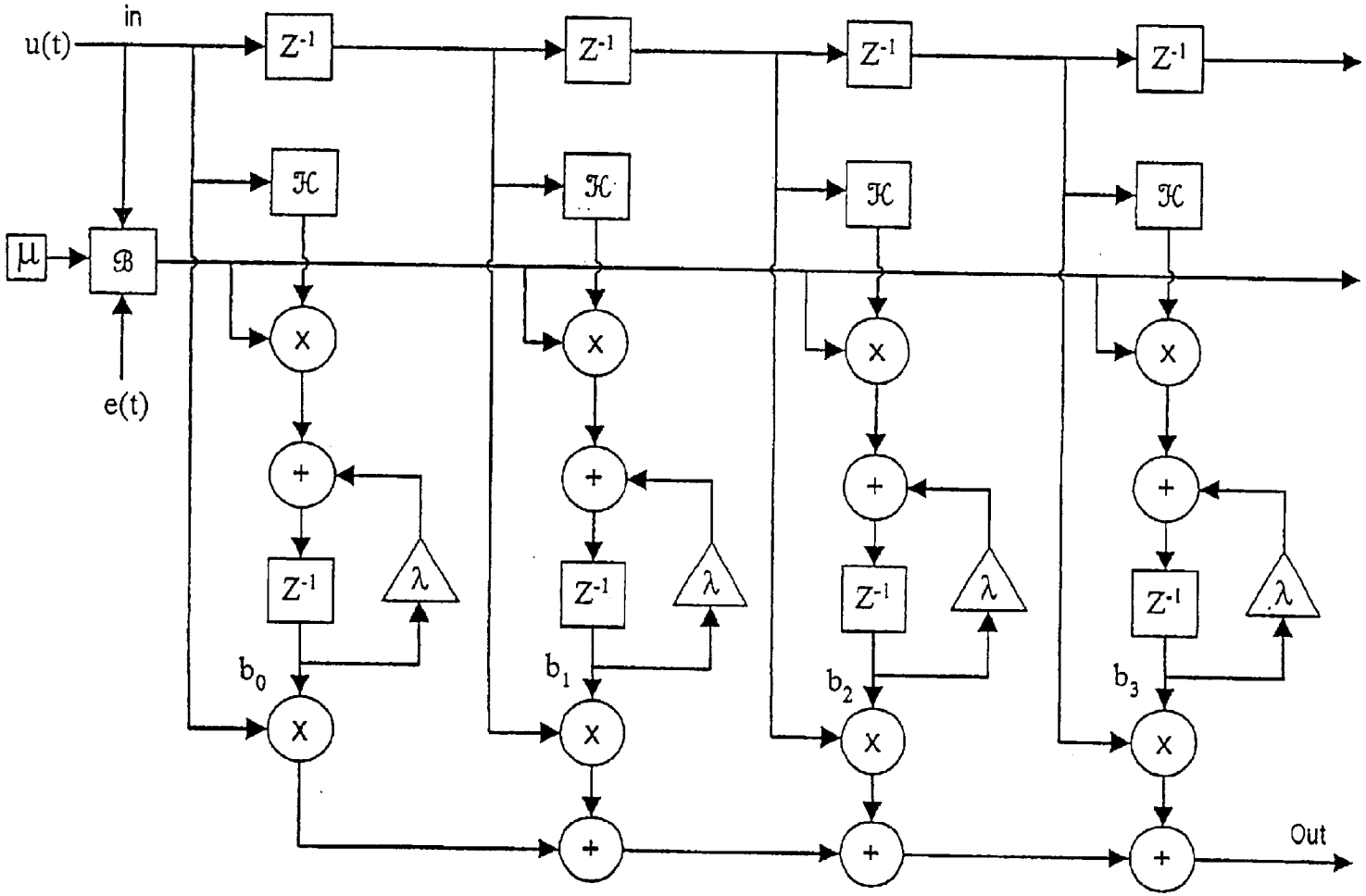
FIG. 6 is a block diagram illustrating an LMS type FIR filter implementing the update algorithms according to the invention.

A FIR filter embodiment of the filter 10 is shown in more detail in FIG. 6. For simplicity only the first four taps are shown, but the filter may comprise any appropriate number of taps. If the operator H is set to 1 and the operator B is set to $\mu(e(n))$, a leaky least mean square algorithm is achieved. If $\lambda$ is set to 1, a simple least mean square algorithm is achieved. If H is set to 1 and B is set to $\mu\mathrm{sgn}(e(n))$, a leaky sign least mean square algorithm is achieved. Finally H may be set to $\mathrm{sgn}(u_i(n))$ and B may be set to $\mu\mathrm{sgn}(e(n))$ thus achieving a leaky sign-sign LMS algorithm. The filter coefficients may also be calculated using recursive least square algorithms.

Figure 7:
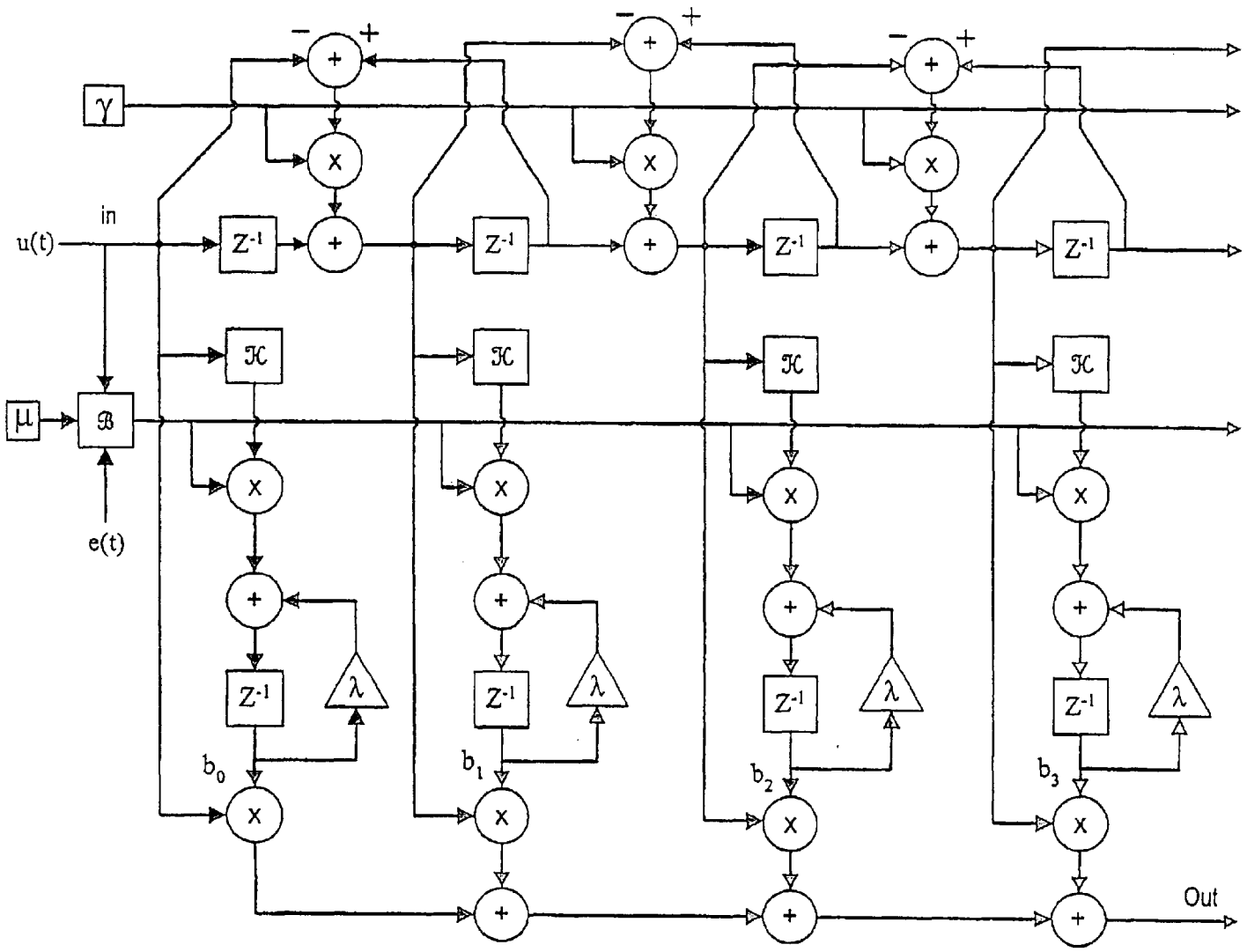
FIG. 7 is a block diagram illustrating an LMS type warped FIR filter implementing the update algorithms according to the invention.

A warped FIR filter embodiment of the filter 10 is shown in more detail in FIG. 7. It should be noted that the circuitry below the upper delay line in FIG. 6 and in FIG. 7 are identical. It is preferred that the warping parameter $\gamma$ is equal to 0.5. It should be noted that for $\gamma=0$, the warped FIR filter turns into a FIR filter.

Figure 8:
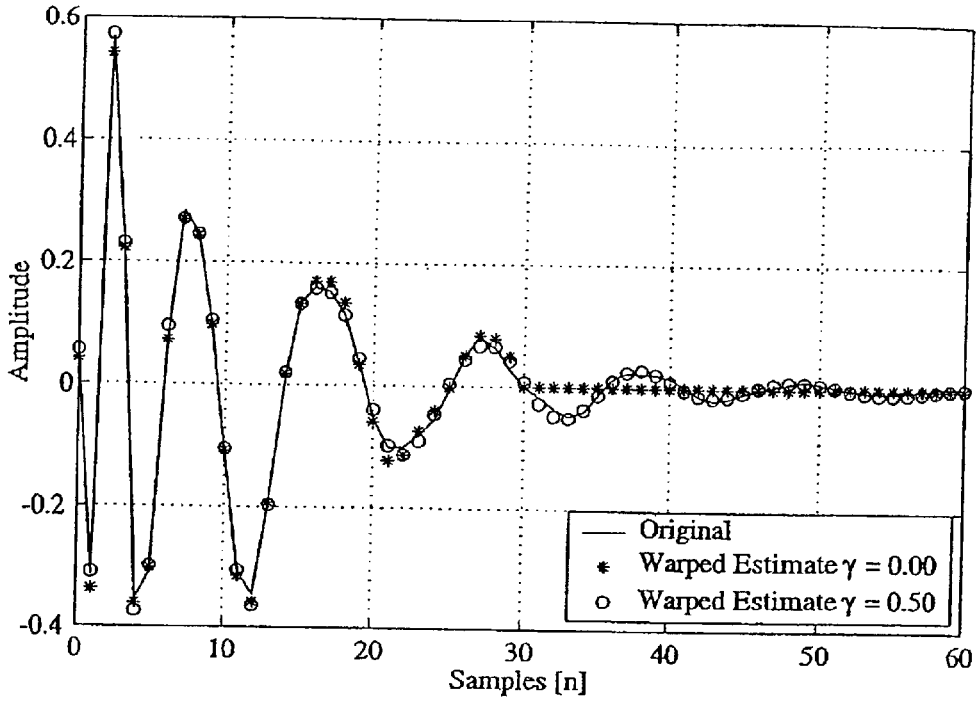
FIG. 8 is a plot of an impulse response of a FIR filter compared to an impulse response of a warped FIR filter.

FIG. 8 shows a plot of the infinite impulse response of a warped FIR filter and the finite response of a FIR filter. The plot indicates that a warped FIR filter inherently has a better capability of approximating a desired transfer function than a FIR filter.

Figure 9:
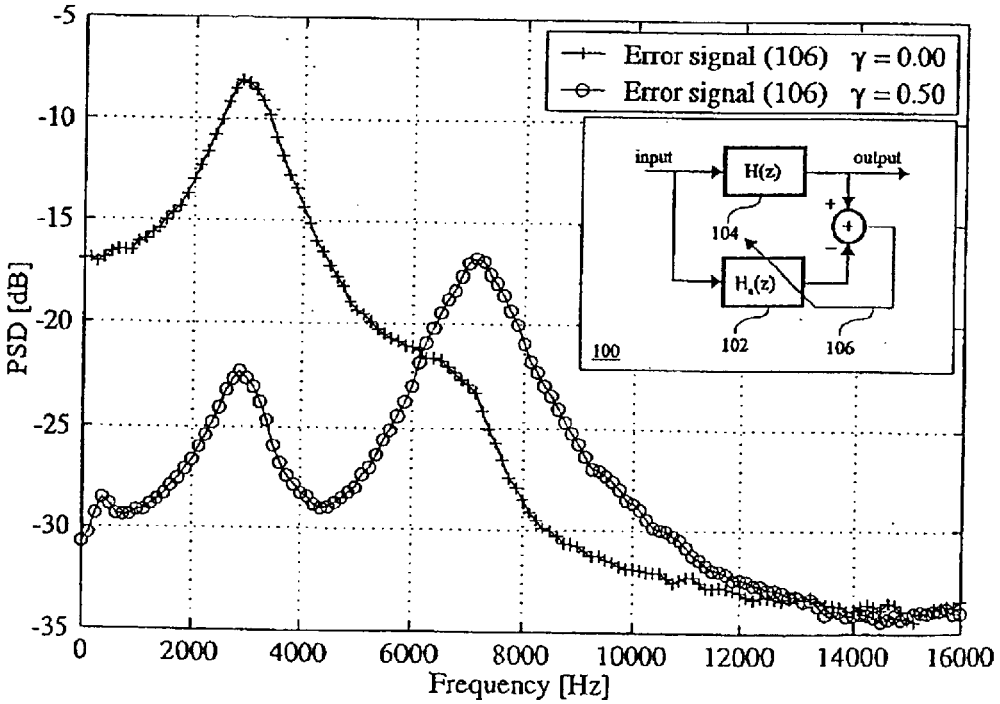
FIG. 9 is a plot of the deviation from a desired transfer function of a FIR filter and a warped FIR filter.

FIG. 9 shows a blocked diagram of a test circuit 100 for determination of the transfer function $H_a$ of an adaptive filter 102 adapting to a desired transfer function H of another filter 104. The plotted curves shows the power spectrum 108 of the error signal 106 when the adaptive filter 102 is a warped FIR filter together with the power spectrum 110 of the error signal 106 when the adaptive filter 102 is a FIR filter. The FIR filter and the warped FIR filter have the same number of tabs. It is seen that below 6–7 kHz the warped FIR filter improves the error signal by up to 15 dB. Since the output of the output transducer 5 typically has a cut-off frequency around 6–8 kHz, the performance of the warped FIR filter above 8 kHz is unimportant. It should be noted that changes in the sampling frequency will shift the frequency values indicated along the frequency axis. It is also noted that $\gamma$ may be adjusted for optimizing the spectrum of the error signal 106 for a specific application, such as a specific type of hearing deficiency.

Figure 2:
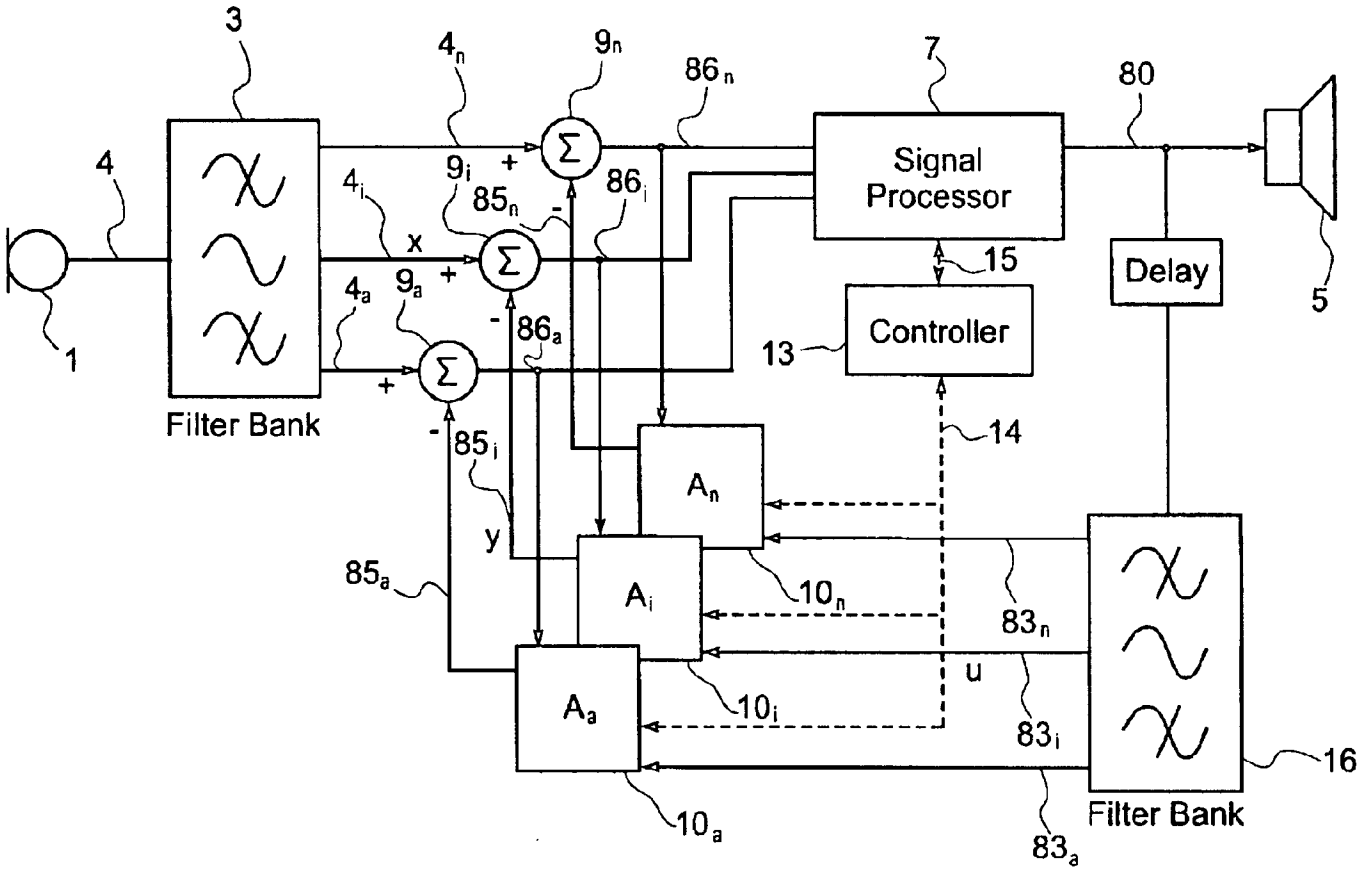
FIG. 2 is a block diagram of a multichannel hearing aid in which each channel corresponds to the hearing aid shown in FIG. 1.

FIG. 2 shows a multichannel embodiment of a hearing aid according to the present invention in which each channel generally operates in the same way as the single channel embodiment shown in FIG. 1. Corresponding parts of FIG. 1 and FIG. 2 are referenced by the same reference numbers except that indexes are added to the reference numbers of FIG. 2. For simplicity only three channels are indicated in FIG. 2. It should be noted, however, that the hearing aid may contain any appropriate number of channels.

The multichannel embodiment of the invention according to FIG. 2 comprises the same parts as the single channel embodiment shown in FIG. 1 in addition to a filter bank 3 that outputs bandpass filtered signals 4*a*, 4*i*, 4*n*. In combining nodes 9*a*, 9*i*, 9*n* the respective signals 4*a*, 4*i*, 4*n* are combined to form respective signals 86*a*, 86*i*, 86*n*. The signals 86*a*, 86*i*, 86*n* are fed to the multichannel digital processor 7 for processing according to a desired characteristic that matches the hearing deficiency of the user. This may involve adjustment of different gain settings in the individual channels. Further the processing may also involve compressor functions. Still further, other functions such as noise reduction may be performed by the signal processor.

The output signal from the digital signal processor 7 is fed to a filter bank 16 where it is split into bandpass filtered signals 83*a*, 83*i*, 83*n* corresponding to the different frequency bands or channels in the set of adaptive filters 10*a*, 10*i*, 10*n*. Preferably, the filter bank 16 comprises a digital fourth order filter.

From the adaptive filters 10*a*, 10*i*, 10*n* the filtered signals 85*a*, 85*i*, 85*n* are fed to the respective combining nodes 9*a*, 9*i*, 9*n* for subtraction from the signals 4*a*, 4*i*, 4*n* and generation of the signals 86*a*, 86*i*, 86*n*. As in the embodiment of FIG. 1, an optional delay line Δ may delay the output signal 80. Preferably, the delay is substantially equal to the maximum propagation time of sound from the output transducer 5 to the input transducer 1.

The processor 7 combines the signals of its channels into a single output signal 80.

In a multichannel embodiment, the adaptation rates of the respective channels may be different from each others. Thus, it is possible to apply higher adaptation rates with the resulting undesired distortion at frequencies where feedback resonance is likely to occur. This is an advantageous feature if feedback resonance occurs at frequencies that are unimportant to desired signals.

Further, signal detection is more difficult to perform in a broad frequency range. Thus, a multichannel system is less likely to produce convergence errors due to incorrect signal detection than a single channel system.

In one embodiment, the controller 13 controls the adaptation rate of the filter coefficients in the adaptive filter 10,

10*a*, 10*i*, 10*n* as a function of the actual operating gains in the processor in a gain interval from $G_0$ to $G_a$.

Figure 3:
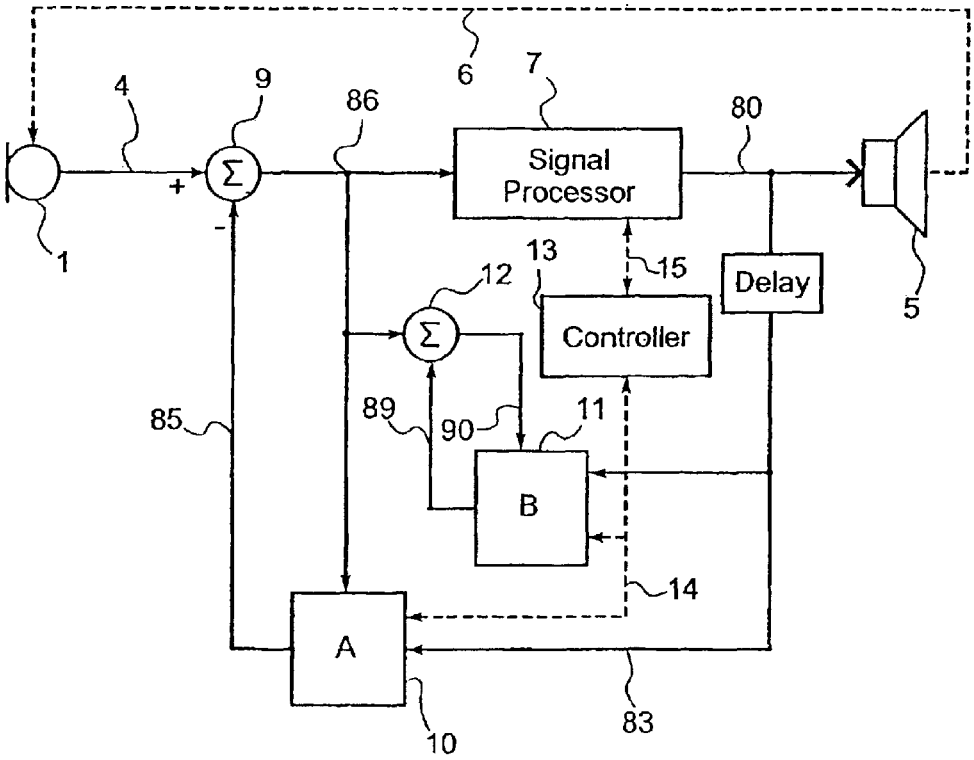
FIG. 3 is a block diagram of a hearing aid incorporating a measuring system according to the invention.

The hearing aid illustrated in FIG. 3 corresponds to the hearing aid of FIG. 1 with an added measuring system. Corresponding parts are referenced by identical reference numbers and explanation of their operation is not repeated. The hearing aid shown in FIG. 3 further comprises a second adaptive filter B, reference 11, operating in parallel with, i.e. on the same signals as, the first adaptive filter A 10 but with a second convergence rate that is higher than the first convergence rate of the first adaptive filter A 10. The output 85 of the first adaptive filter A 10 is fed to the combining node 9 for subtraction from the signal 4 and generation of the signal 86 input to the processor 7 whereby the acoustic feedback signal is substantially removed from the signal before processing by the processor 7. It should be noted that the output 89 of the second adaptive filter B 11 is not used for modification of the processor input.

In this embodiment, the controller 13 is adapted to estimate the amount of acoustic feedback by determination of a parameter of the second adaptive filter 11. The high first convergence rate allows the second adaptive filter 11 to track the acoustic feedback more closely over time than the first adaptive filter 10. Further, since the output signal 89 of the second adaptive filter 11 is not subtracted from the input transducer signal 4, the desired signal is not distorted by the second adaptive filter 11.

The first adaptive filter 10 may be any kind of adaptive filter, but is preferably a FIR filter or a warped FIR filter using a power-normalized Least Mean Square (power-nLMS) algorithm.

The second adaptive filter 11 outputs a filtered signal 89 to a second combining node 12 where it is combined with the signal 86 from the first combining node 9. The output signal 90 from the combining node 12 is input to the second adaptive filter 11 for adjustment of the filter coefficients.

It is an important advantage of the embodiment shown in FIG. 3 that the output signal generated by the second adaptive filter 11 is not fed into the main signal path from the input transducer 1 to the output transducer 5. The main signal path comprises the input transducer 1, the digital conversion means (not shown), the combining node 9, the digital processor 7 and the output transducer 5. Consequently, the signal processing by the second adaptive filter 11 does not affect the signal in the main signal path directly. Thus, no signal distortion of signals in the main signal path is created by the second adaptive filter 11, and thus the adaptation rate of the second adaptive filter 11 may be substantially higher than that of the first adaptive filter 10. Since the adaptation rate of the second adaptive filter 11 may be significantly higher than that of the first adaptive filter 10, the feedback path can be monitored much more closely over time for changes by the second adaptive filter 11 than by the first adaptive filter 10. Preferably the second adaptation rate is a fixed high adaptation rate, but the adaptation rate may be adjusted, e.g. by modifying one or more of the scaling factors. For example, it may be preferred to adjust the adaptation rate of the second adaptive filter in accordance with the actual gain in the processor or the input power level.

Adjustment of adaptation rate may differ for different modes of operation.

If rapid changes in the acoustic environment occur, the first adaptive filter 10 of FIG. 3 will not be able to immediately adapt to and compensate for the changes. Accordingly, uncompensated feedback signals will start to emerge. The second adaptive filter 11, however, is much faster than the first adaptive filter 10 and will adapt to the change in the feedback path.

In one embodiment, the controller controls the adaptation rate in the first adaptive filter 10, e.g. controlling the value of $\mu$, based on the rapid response of the second adaptive filter 11 to changes in the feedback path. Thus, if the properties, e.g. the filtering characteristics, such as the attenuation, etc, of the second adaptive filter 11 indicate a change in the feedback path, the first adaptive filter 10 is controlled accordingly, i.e. by increasing the adaptation rate of the first adaptive filter 10 if the gain is close to the feedback limit. The increased adaptation rate of the first adaptive filter 10 allows it to compensate for the change in acoustic feedback more rapidly, e.g. before the acoustic feedback leads to generation of undesired sounds.

It should be noted that the amount of acoustic feedback may be estimated preferably by determination of a parameter of the first adaptive filter 10 or, alternatively or additionally, by determination of a parameter of the second adaptive filter 11. For example, the ratio between the input and the output signal of the respective adaptive filter 10, 11 may be determined since the ratio constitutes an estimate of the attenuation of the feedback path including the acoustical feedback path. Further, it may be desirable to base such a calculation on averaged signals thereby suppressing influence from noise and speech and convergence errors. Alternatively an average of the desired properties may be determined. Preferably, a power estimate of the above-mentioned type is used for each signal. Alternatively, a parameter of one of the adaptive filters 10, 11 may be determined by appropriate transformation of the filter coefficients.

In another embodiment, the controller lowers the gain in the digital processor if a change in feedback is detected by the second adaptive filter 11. In particular this may be performed selectively in the different channels of the digital processor.

Based on the determination of the first parameter, the controller may calculate a maximum gain value $G_{max}$ that the processor is not allowed to exceed in order to avoid generation of undesired sound signals. In a multichannel hearing aid there may be an individual $G_{max}$-value for each channel.

In yet another embodiment, the controller changes the gain interval, $G_0$ to $G_a$. Thus, if the second adaptive filter 11 detects that the system is close to instability, this information may be used to lower the lower gain limit $G_0$ thereby shifting the whole gain interval downwards or expanding the gain interval if it is desired to keep $G_a$ at a specific level. If only the lower gain limit $G_0$ is changed the curves for $\lambda$ and $\mu$ will preferably be changed so as to cover the different interval.

In this respect it should be noted that the relation between the gain and $\lambda$ and $\mu$ may be different from the functions depicted in FIG. 10.

Figure 4:
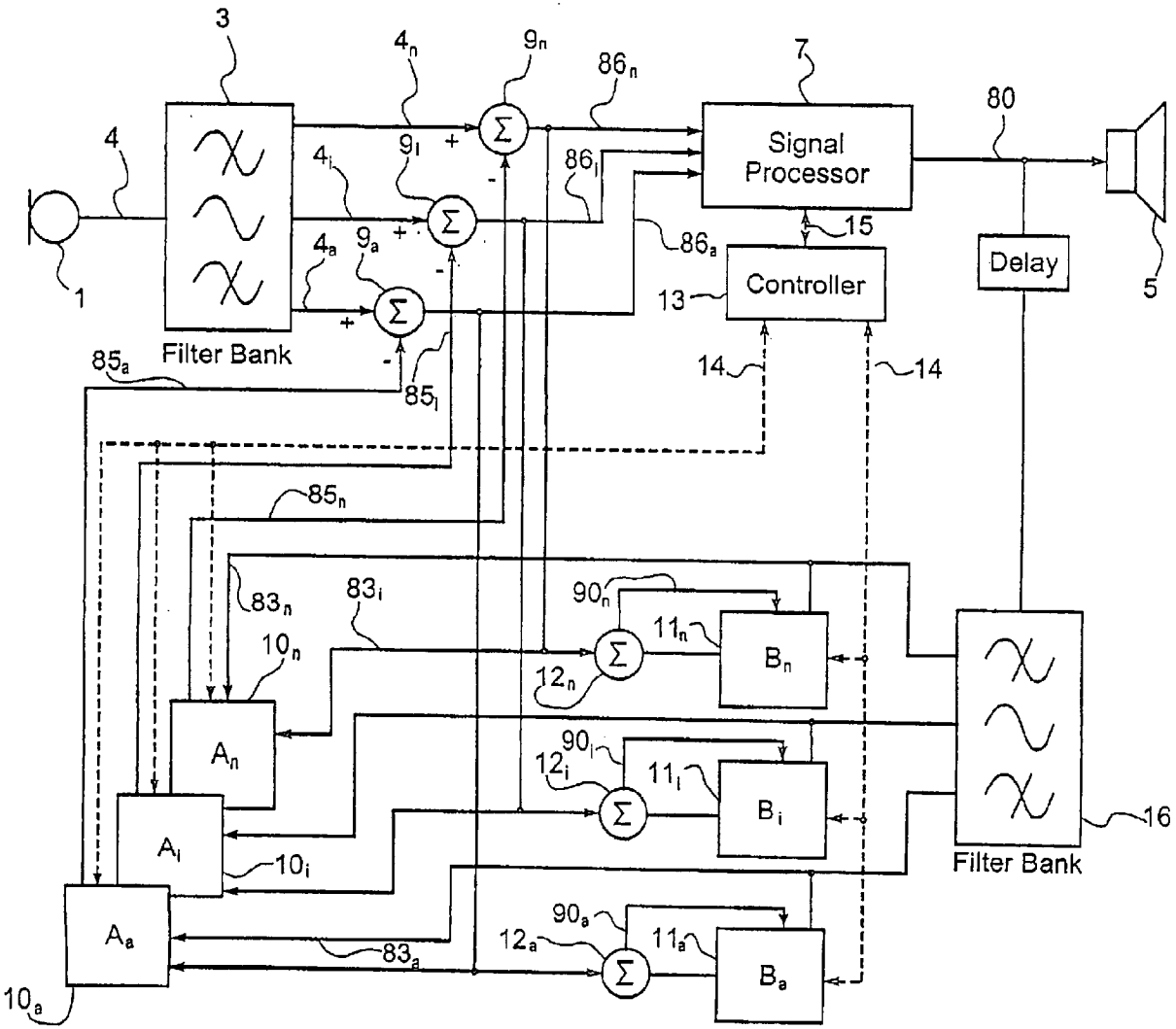
FIG. 4 is a block diagram of a multichannel hearing aid in which each channel corresponds to the hearing aid shown in FIG. 3.

FIG. 4 shows a multichannel embodiment of a hearing aid according to the present invention in which each channel generally operates in the same way as the single channel embodiment shown in FIG. 3. Corresponding parts of FIG. 3 and FIG. 4 are referenced by the same reference numbers except that indexes are added to the reference numbers of FIG. 3. For simplicity only three channels are indicated in FIG. 4. It should be noted, however, that the hearing aid may contain any appropriate number of channels. For simplicity, control lines have been omitted in FIG. 4.

The multichannel embodiment of the invention according to FIG. 4 comprises the same parts as the single channel embodiment shown in FIG. 3 in addition to a filter bank 16 that outputs bandpass filtered signals 83*a*, 83*i*, 83*n* to a first set of adative filters as well as to a second set of adaptive filters 11*a*, 11*i*, 11*n*. The respective second set adaptive filters 11*a*, 11*i*, 11*n* provide filtered signals to respective combining nodes 12*a*, 12*i*, 12*n* for combination with respective signals 86*a*, 86*i*, 86*n*, from the combining nodes 9*a*, 9*i*, 9*n*.

The multichannel embodiment shown in FIG. 4 provides a more detailed estimation of the transfer function of the feedback path. Moreover, signal processing may be performed at lower sampling frequencies in lower frequency bands, a technique known as decimation. Decimation is particularly simple to use in the second set of adaptive filters since no anti-aliasing filter is needed in the system because the output signals from these filters are not fed into the main signal path.

The embodiment shown in FIG. 4 may be controlled in the same way as the embodiment shown in FIG. 3. However, the embodiment shown in FIG. 4 allows selective reduction of the gain in each individual channel and selective adjustment of the adaptation rate of each individual adaptive filter of the first set of adaptive filters 10*a*, 10*i*, 10*n*. This has the further advantage that the gain may be maintained at a high value and the distortion may be maintained at a low level at frequencies where feedback resonance is not likely to occur.

Figure 5:
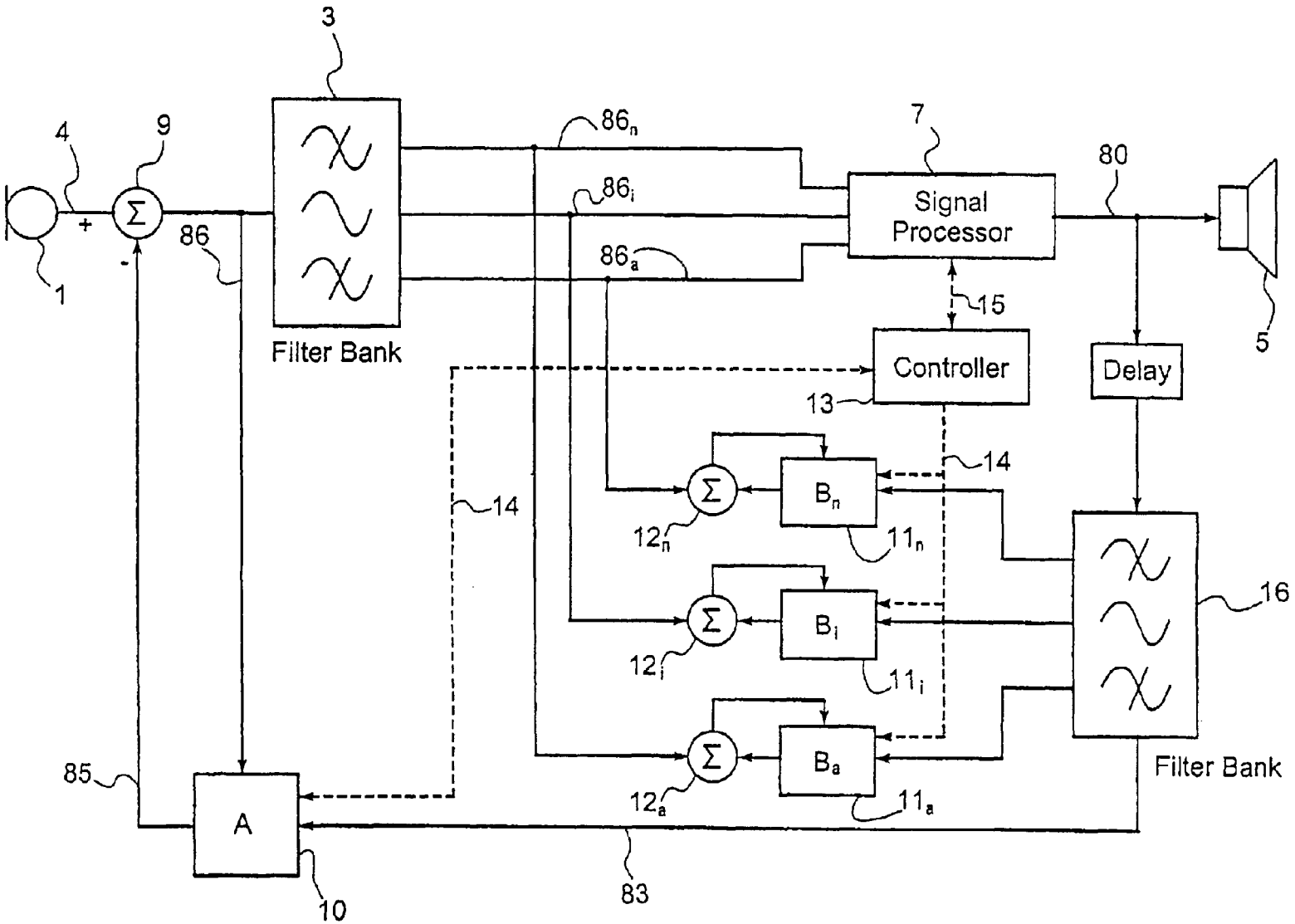
FIG. 5 is a block diagram of a multichannel hearing aid with a single band adaptive filter.

FIG. 5 shows a multichannel embodiment that is similar to and operates in a similar way as the embodiment shown in FIG. 4. However, the embodiment shown in FIG. 5 is simpler since it has a first set of adaptive filters that consists of a single adaptive filter 10 and also, the combining node 9 is a single combining node.

Many other embodiments may be provided with varying numbers of channels in the processor and the first and second sets of adaptive filters. Also the number of channels in the processor may be different from the number of filters in the first set of adaptive filters that again may be different from the number of filters in the second set of adaptive filters.

In particular it is possible to provide a digital signal processor 7 having relatively few channels and a second set of adaptive filters containing more filters. Alternatively, the individual adaptive filters of the first set of filters may operate on a combination of channels in the digital signal processor 7, e.g. two or more channels in the digital signal processor 7 may operate with the same $G_{max}$ determined by a specific adaptive filter of the second set of adaptive filters or, a channel in the digital signal processor 7 may operate with a $G_{max}$ that is the lowest gain of two or more gains determined by adaptive filters of the second set of adaptive filters. At present, however, the embodiment with a single first adaptive filter 10 and a multichannel second set of adaptive filters 11 is preferred.

Figure 11:
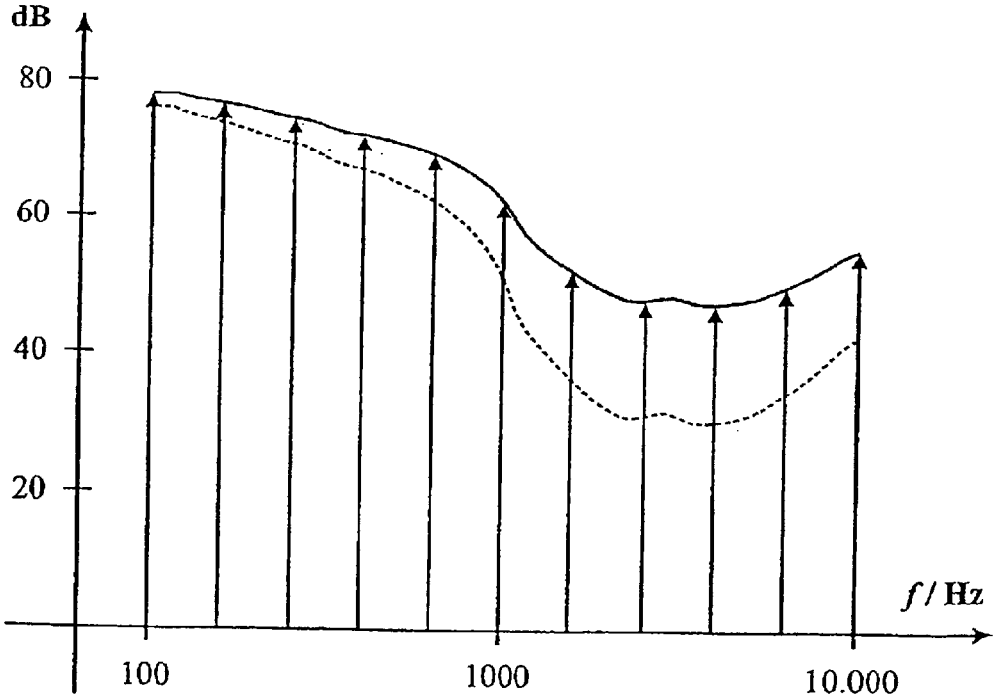
FIG. 11 is a diagram illustrating the improvement in maximum possible gain achieved with the present invention.

In FIG. 11, a plot of operating gains as a function of frequency is shown. The upper solid curve shows the maximum operating gain that can be obtained with a hearing aid according to the present invention without generation of undesired sounds, and the lower dashed curves shows the corresponding gain for a known hearing aid.

What is claimed is:

1. A hearing aid comprising an input transducer for transforming an acoustic input signal into a first electrical signal, a first combining node for receiving said first electrical signal and combining it with a third electrical signal in order to output a first combining node output signal, a processor for generation of a second electrical signal by processing of said first combining node output signal, an output transducer for transforming the second electrical signal into an acoustic output signal, a first adaptive filter with first filter coefficients for estimation of acoustic feedback by generation of a third electrical signal by filtering of said second electrical signal, wherein the first filter coefficients are updated with a first convergence rate, a second adaptive filter with second filter coefficients for filtering said second electrical signal into a fourth electrical signal, means for determining a maximum allowable gain of said processor, and a second combining node for generation of a fifth electrical signal by combining the fourth electrical signal with the first combining node output signal and for inputting the fifth electrical signal to said second adaptive filter, wherein the second filter coefficients are updated with a second convergence rate.

2. The hearing aid according to claim 1, wherein said first combining node is adapted for subtraction of the third electrical signal from the first electrical signal in order to generate said first combining node output signal.

3. The hearing aid according to claim 1, comprising a delay line for delaying said second electrical signal and for feeding the delayed second electrical signal to said first adaptive filter.

4. The hearing aid according to claim 1, wherein said second convergence rate is higher than said first convergence rate.

5. The hearing aid according to claim 1, comprising a controller adapted to estimate the amount of acoustic feedback based on information from said second adaptive filter.

6. The hearing aid according to claim 5, wherein said controller is adapted to monitor attenuation in said first adaptive filter by determination of the ratio between the magnitude of the signal at the input of said first adaptive filter and the signal at the output of said first adaptive filter.

7. The hearing aid according to claim 5, wherein said controller is adapted to monitor the gain of said processor by a determination of input and output signal levels of said processor.

8. The hearing aid according to claim 5, wherein said controller is adapted to monitor the gain of said processor by reading values from registers in the processor.

9. The hearing aid acording to claim 5, wherein said controller is adapted to adjust said second filter coefficients.

10. The hearing aid acording to claim 5, wherein said controller is adapted to adjust said second convergence rate.

11. The hearing aid according to claim 1, comprising means for updating at least one of said first and said second set of filter coefficients according to a leaky least mean square algorithm:

$$c_i(n+1)=\lambda(c_i(n)-c_i(0))+c_i(0)+\mu u_i(n)e(n)$$

where $c_i(n+1)$ is the updated value of i'th filter coefficient, $c_i(n)$ is the current value of the i'th filter coefficient, $c_i(0)$ is the initial value of the i'th filter coefficient, $u_i(n)$ is the (n−i)'th sample of the processor output signal, e(n) is the current sample of the second electrical signal, $\lambda$ is the leakage, and $\mu$ is the convergence, $\lambda$ and $\mu$ determining the first convergence rate.

12. The hearing aid according to claim 1, comprising means for updating at least one of said first and said second set of filter coefficients according to a normalized Least Mean Square:

$$\underline{c}(n+1) = \lambda(\underline{c}(n) - \underline{c}(0)) + \underline{c}(0) + \mu\frac{\underline{u}(n)}{\underline{u}(n)^{\circ}\underline{u}(n)}e(n)$$

where $\underline{u}(n)$ is an N dimensional vector containing the latest N samples of the signal u, $\underline{c}(n)$ is a vector containing the current values of the N filter coefficients, $\underline{c}(0)$ is a vector containing the initial values of the N filter coefficients, $\underline{c}(n+1)$ is the updated values of the N filter coefficients, and e(n) is the current sample of the second electrical signal.

13. The hearing aid according to claim 1, comprising means for updating at least one of said first and said second set of filter coefficients according to a power normalized Least Mean Square algorithm.

$$P_u(t+T)=\alpha P_u(t)+(1-\alpha)u^2(t)$$

where $\alpha$ is a predetermined constant that determines the rate with which the $P_u$ estimate changes.

14. The hearing aid according to claim 1, comprising means for updating at least one of said first and said second set of filter coefficients according to a leaky sign least mean square algorithm:

$$c_i(n+1)=\lambda(c_i(n)-c_i(0))+c_i(0)+\mu_s u_i(n)$$

where $c_i(n+1)$ is the updated value of i'th filter coefficient, $c_i(n)$ is the current value of the i'th filter coefficient, $c_i(0)$ is the initial value of the i'th filter coefficient, $u_i(n)$ is the (n−i)'th sample of the processor output signal, e(n) is the current sample of the second electrical signal, $\lambda$ is the leakage, and $\mu$ is the convergence, and $\mu_s$ is the sign of the e(n) signal multiplied by $\mu$, $\lambda$ and $\mu$ determining the first convergence rate.

15. The hearing aid according to claim 1, comprising means for updating at least one of said first and said second set of filter coefficients according to a leaky sign-sign least mean square algorithm:

$$c_i(n+1)=\lambda(c_i(n)-c_i(0))+c_i(0)+\mu_s sgn(u_i(n))$$

where $c_i(n+1)$ is the updated value of i'th filter coefficient, $c_i(n)$ is the current value of the i'th filter coefficient, $c_i(0)$ is the initial value of the i'th filter coefficient, $u_i(n)$ is the (n−i)'th sample of the processor output signal, e(n) is the current sample of the second electrical signal, $\lambda$ is the leakage, and $\mu$ is the convergence factor, and $sgn(u_i(n))$ is the sign of $u_i(n)$, $\lambda$ and $\mu$ determining the first convergence rate.

16. A hearing aid comprising an input transducer for transforming an acoustic input signal into a first electrical signal, a first filter bank with bandpass filters for dividing the first electrical signal into a set of bandpass filtered first electrical signals, a first set of combining nodes for receiving the set of bandpass filtered first electrical signals and combining them with a set of third electrical signals in order to output a set of first combining node output signals, a processor adapted for individual processing of each signal among the set of first combining node output signals and adding together the processed electrical signals in order to generate a second electrical signal, an output transducer for transforming said second electrical signal into an acoustic output signal, a second filter bank with bandpass filters for dividing said second electrical signal into a set of bandpass filtered second electrical signals, the bandpass filters of the second filter bank being substantially identical to respective bandpass filters of the first filter bank, a first set of adaptive filters for estimating acoustic feedback by filtering of the bandpass filtered second electrical signals according to a set of first filter coefficients and generating the set of third electrical signals, a second set of adaptive filters with second filter coefficients for filtering the bandpass filtered second electrical signals into respective fourth electrical signals, a second set of combining nodes for generation of a set of fifth electrical signals by combining the fourth electrical signals with the respective signals of the set of first combining node output signals, and for inputting said fifth electrical signals to said second set of adaptive filters for adjustment of the second filter coefficients, and a controller adapted to estimate the amount of acoustic feedback based on information from said second set of adaptive filters and adapted to determine an operating gain of said processor.

17. The hearing aid according to claim 16, wherein at least one of the adaptive filters of the first set of adaptive filters operates on a respective decimated bandpass filtered second electrical signal.

18. The hearing aid according to claim 16, wherein said first set of combining nodes are adapted for subtraction of the third signals from the respective bandpass filtered first electrical signals in order to generate the set of first combining node output signals.

19. The hearing aid according to claim 16, comprising a delay line for delaying said second electrical signal and for feeding the delayed second electrical signal to said first set of adaptive filters.

20. The hearing aid according to claim 16, wherein said first filter coefficients are updated with a first convergence rate, and wherein said second filter coefficients are updated with a second convergence rate that is higher than said first convergence rate.

21. The hearing aid according to claim 16, comprising a controller adapted to estimate the amount of acoustic feedback based on information from said second set of adaptive filters.

22. The hearing aid according to claim 21, wherein said controller is adapted to monitor attenuation in said first set of adaptive filters by determination of the ratios between the respective magnitudes of the signals at the inputs of said first adaptive filter and the signals at the outputs of said first set of adaptive filters.

23. The hearing aid according to claim 21, wherein said controller is adapted to monitor the gain of said processor by a determination of input and output signal levels of said processor.

24. The hearing aid according to claim 21, wherein said controller is adapted to adjust the second filter coefficients.

25. The hearing aid according to claim 21, wherein said controller is adapted to adjust said second convergence rate.

26. A hearing aid comprising an input transducer for transforming an acoustic input signal into a first electrical signal, a first combining node for receiving said first electrical signal and combining it with a third electrical signal in order to output a first combining node output signal, a first filter bank with bandpass filters for dividing the first combining node output signal into a first set of bandpass filtered electrical signals, a processor adapted for individual processing of each signal among the first set of bandpass filtered electrical signals and adding together the processed electrical signals in order to generate a second electrical signal, an output transducer for transforming said second electrical signal into an acoustic output signal, a second filter bank with bandpass filters for dividing said second electrical signal into a second set of bandpass filtered electrical signals, the bandpass filters of the second filter bank being substantially identical to respective bandpass filters of the first filter bank, a first adaptive filter for estimating acoustic feedback by filtering of the second electrical signal according to a set of first filter coefficients and generating the third electrical signal, a second set of adaptive filters with second filter coefficients for filtering the bandpass filtered second electrical signals into respective fourth electrical signals, a second set of combining nodes for generation of a set of fifth electrical signals by combining the fourth electrical signals with the respective signals of the set of first combining node output signals, and for inputting said fifth electrical signals to said second set of adaptive filters for adjustment of the second filter coefficients, and a controller adapted to estimate the amount of acoustic feedback based on information from said second set of adaptive filters and adapted to determine an operating gain of said processor.

27. The hearing aid according to claim 26, comprising a delay line for delaying said second electrical signal and for feeding the delayed second electrical signal to said first adaptive filter.

28. The hearing aid according to claim 26, wherein said first filter coefficients are updated with a first convergence rate, and wherein said second filter coefficients are updated with a second convergence rate that is higher than said first convergence rate.

29. The hearing aid according to claim 26, comprising a controller adapted to estimate the amount of acoustic feedback based on information from said second set of adaptive filters.

30. The hearing aid according to claim 29, wherein said controller is adapted to monitor attenuation in said first adaptive filter by determination of the ratio between the magnitude of the signal at the input of said first adaptive filter and the signal at the output of said first adaptive filter.

31. The hearing aid according to claim 29, wherein said controller is adapted to monitor the gain of said processor by a determination of input and output signal levels of said processor.

32. The hearing aid according to claim 29, wherein said controller is adapted to adjust the second filter coefficients.

33. The hearing aid according to claim 29, wherein said controller is adapted to adjust said second convergence rate.

* * * * *

UNITED STATES PATENT AND TRADEMARK OFFICE

CERTIFICATE OF CORRECTION

PATENT NO. : 6,898,293 B2
APPLICATION NO. : 10/742789
DATED : May 24, 2005
INVENTOR(S) : Thomas Kaulberg It is certified that error appears in the above-identified patent and that said Letters Patent is hereby corrected as shown below:

On Title Page Item (73) Assignee: Delete "Topholm & Westermann ApS" and insert --Widex A/S--

Signed and Sealed this

Twenty-sixth Day of February, 2008

JON W. DUDAS
*Director of the United States Patent and Trademark Office*